US005504271A

United States Patent [19]

Curtis et al.

[11] Patent Number: 5,504,271

[45] Date of Patent: Apr. 2, 1996

[54] OVEN

[75] Inventors: Michael Curtis, Wantage; John Clarke, Faringdon; David J. Lusty, Carterton; David L. Allinson, Abingdon; Geoffrey H. Rumble, Wantage, all of United Kingdom

[73] Assignee: CarnaudMetalbox plc, Worcester, United Kingdom

[21] Appl. No.: 108,605

[22] PCT Filed: Feb. 25, 1992

[86] PCT No.: PCT/GB92/00335

§ 371 Date: Aug. 24, 1993

§ 102(e) Date: Aug. 24, 1993

[87] PCT Pub. No.: WO92/14979

PCT Pub. Date: Sep. 3, 1992

[30] Foreign Application Priority Data

Feb. 26, 1991 [GB] United Kingdom ..... 9103962

[51] Int. Cl.[6] ..... B05C 11/00

[52] U.S. Cl. ..... 118/66; 34/247; 34/646; 118/61; 118/69; 118/64

[58] Field of Search ..... 198/626.5, 721, 198/726, 803.11; 226/7, 97; 414/157, 176, 214; 34/640, 646, 643, 652, 247, 428, 429, 430, 659, 664, 420, 419, 421; 118/58, 61, 69, 50, 62, 66, 64

[56] References Cited

U.S. PATENT DOCUMENTS

| | | | |
|---|---|---|---|
| 3,594,149 | 7/1971 | Pickavance et al. | 198/721 |
| 3,633,231 | 1/1972 | Vits | 34/640 |
| 3,739,486 | 6/1973 | Kallenburg | 34/652 |
| 3,800,432 | 4/1974 | Miyatz | 34/640 |
| 4,148,476 | 4/1979 | Brekell | 271/194 |
| 4,343,769 | 8/1982 | Henkelman | 34/640 |
| 5,136,973 | 8/1972 | Nies et al. | 118/50 |

FOREIGN PATENT DOCUMENTS

| | | |
|---|---|---|
| 1367381 | 9/1974 | United Kingdom . |
| 1367382 | 9/1974 | United Kingdom . |
| 1505622 | 3/1978 | United Kingdom . |
| 2020401 | 11/1979 | United Kingdom . |
| 9003099 | 3/1990 | WIPO . |

*Primary Examiner*—Brenda A. Lamb
*Attorney, Agent, or Firm*—Christie, Parker & Hale

[57] ABSTRACT

An oven for curing coating material applied to metal sheets (15) has a heating section (17), a cooling section (18) and an incinerator (19) for burning fumes from the coating material. The oven also as a conveyor for carrying sheets through it. The oven is associated with a sheet feeder (11), a coating apparatus (12), and a sheet stacker (13). In one embodiment, a conveyor (16) comprises an air bed (30) and two series of drive members (35) mounted on two endless chains (36). Air is ejected through a matrix of slots in the air bed (30) and thereby creates a cushion for supporting the sheets (15). The air is ejected in a direction which urges the trailing edges of the sheets into engagement with the drive members (35) and the drive members (35) propel the sheets through the oven. In another embodiment, a conveyor (200) comprises two series of drive members (205, 206) mounted on spaced apart chain (208, 209) and arranged in pairs for engaging the trailing and leading edges of metal sheets. The sheets (15) are supported on a cushion of air ejected from an air bed (201).

12 Claims, 17 Drawing Sheets

OVEN

TECHNICAL FIELD

This invention relates to an oven for curing coating material applied to metal sheets. This invention is particularly, but not exclusively, concerned with an oven for curing coating material applied to metal sheets which are used, for example, in the manufacture of metal cans, ends for metal cans, metal boxes and metal trays. The term "metal sheet", as used herein, means a sheet formed wholly or partly from metal.

BACKGROUND ART

As a preliminary step in the manufacture of metal cans from a metal sheet, one or more layers of coating material are applied to the sheet. These layers may provide functional protective features and may also be applied for decorative purposes. Examples of such coating material are sizes, pigmented coatings, inks, lacquers and varnishes. For example, where a metal sheet is to be used in the manufacture of bodies for three piece metal food cans, a layer of lacquer may be applied to one surface of the sheet. By way of another example, where a metal sheet is to be used in the manufacture of bodies for aerosol cans, a layer of lacquer may be applied to one surface of the sheet and layers of size, white coating, inks, and varnish may be applied, in turn, to the other surface. Where a metal sheet is being used in the manufacture of can bodies, after it has received the required number of layers of coating material, small rectangular workpieces are cut from the sheet and these are then formed into can bodies. Where a sheet is used in the manufacture of other components, for example, ends for can bodies, workpieces of suitable shape and size are cut from the metal sheet and then formed into the desired components.

After a layer of coating material has been applied to a metal sheet, the coating material is cured by passing the sheet through an oven. A conventional oven for metal sheets comprises a heating section, a cooling section and a wicket conveyor. A wicket conveyor comprises a series of wickets which are mounted at spaced intervals on endless chains. Each wicket is arranged to carry a sheet through the oven in a substantially vertical position with the coated and wet surface of the sheet out of contact with the wicket. When an oven is in operation, the wicket conveyor carries sheets in turn firstly through the heating section and then through the cooling section. In the heating section, heated air is passed over the sheets. Typically, in the heating section the temperature of each sheet is raised to a temperature in the range of 120° C. to 230° C., the transit times of the sheets through the heating and cooling sections are 10 to 20 minutes and 3 to 5 minutes, respectively, and 5000 sheets an hour enter the oven. Thus, it is normal for about 1600 sheets to be present in an oven. The temperature and transit times may be varied in accordance with the specific coating material being used.

There are various problems associated with the conventional oven. During operation, volatile components from the coatings condense on the wickets. In other circumstances, the wickets may corrode. Thus, the wickets are a source of dirt. If such dirt is carried by air currents in the oven and transferred to a layer of coating material while it is still wet, the coating material is spoilt. In order to reduce the presence of dirt, the wickets are cleaned periodically and this results in a loss of production time. As a metal sheet is carried through the heating section by a wicket, there are periods when the wicket and metal sheet are at different temperatures. Consequently, heat transfer between the wicket and the metal sheet can interfere with the curing process and this leads to marks in the cured layer of coating material. The wickets are prone to vibration and the vibration together with sheet movements induced by air currents can cause abrasion damage on the sides of the sheets resting on the wickets. Occasionally, uneven heating causes a sheet to buckle. Such buckling together with movement induced by air currents can cause contact between a sheet and a neighboring wicket. Such contact causes damage to the coating. Because one surface of a metal sheet rests against a wicket as it passes through the oven, it is possible to cure only a single surface of the sheet during each passage. While the arrangement of coated sheets supported on their lower edges on wickets has proved satisfactory for many years (apart from the problems just mentioned), there is now a requirement to coat thinner metal sheets having thicknesses less than 0.2 mm. Such sheets tend to bend when supported on their edges and such bending could cause contact between a sheet and a neighboring wicket.

DISCLOSURE OF THE INVENTION

It is an object of this invention to provide a new or improved oven for curing coating material applied to workpieces in the form of sheets in which the above mentioned disadvantages are overcome or reduced.

According to this invention, there is provided an oven for curing coating material applied to metal sheets, said oven comprising a heating section for applying heat to metal sheets and a conveyor for conveying metal sheets through the heating section, in which the conveyor comprises an elongate bed extending through the heating section, a plenum chamber located beneath the bed, a matrix of jets formed in the bed for supplying gas from the plenum chamber to the space above the bed so as to form a gas cushion, the gas cushion being capable of supporting metal sheets, and means for propelling sheets along the bed.

Because the sheets are propelled through the oven on a gas cushion, the use of wickets is eliminated. Consequently, the various problems associated with wickets do not exist.

In one arrangement of the conveyor, the propelling means comprises at least one endless line extending through the heating section, means for imparting motion to said at least one endless line and a series of drive members mounted on said at least one endless line at spaced apart intervals, said drive members being arranged to engage the trailing edges of metal sheets passing along the conveyor, and the jets being arranged to eject gas in a direction which urges the metal sheets into engagement with the drive members.

In another arrangement, the propelling means comprises at least one endless line extending through the heating section, means for imparting motion to said at least one endless line, a first series of drive members mounted on said at least one endless line at spaced apart intervals, said first series of drive members being arranged to engage the leading edges of metal sheets passing along the conveyor, and a second series of drive members mounted on said at least one endless line at spaced apart intervals, said second series of drive members being arranged to engage the trailing edges of metal sheets passing along the conveyor.

Conveniently, the heating section includes a second plenum chamber having a lower wall positioned above the bed of the conveyor, means for supplying heated gas to the second plenum chamber, and means for injecting gas from the second plenum chamber to the space below said lower wall.

Desirably, the injecting means comprises a set of slots in said lower wall, each slot being oriented so that its projection onto the bed of the conveyor is inclined to the direction of travel of workpiece along the conveyor by an angle less than 90° C.

By orienting the slots in this manner, there is less tendency for the gas injected from the second plenum chamber to induce vibrations in or disturbance of the sheets.

The oven as set forth in the preceding paragraphs may be combined with a coating apparatus, the coating apparatus being arranged to apply a layer of coating material simultaneously to both surfaces of a sheet.

BRIEF DESCRIPTION OF THE DRAWINGS

This invention will now be described in more detail, by way of example, with reference to the drawings in which.

MODES OF CARRYING OUT THE INVENTION

Figure 1:
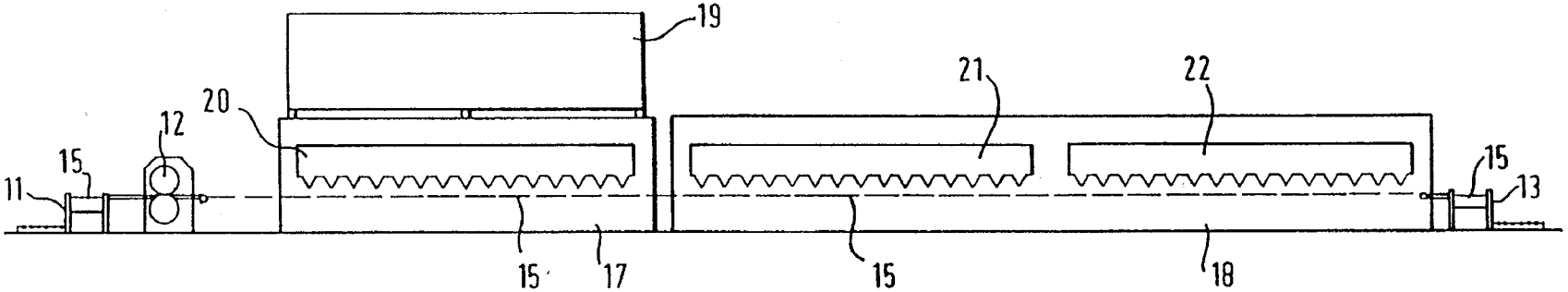
FIG. 1 is a diagrammatic side view of an oven embodying this invention together with an associated sheet feeder, coating apparatus and sheet stacker.

Referring now to FIG. 1, there is shown an oven 10 together with an associated sheet feeder 11, coating apparatus 12, and sheet stacker 13. The sheet feeder 11 and sheet stacker 13 are of well known design.

In operation, metal sheets 15 are supplied by the sheet feeder 11 to the coating apparatus 12. The sheets 15 are then carried by a conveyor, not shown in FIG. 1, from the coating apparatus 12 through the oven 10 and they are then stacked by the sheet stacker 15. Two embodiments of the conveyor will be described below. The conveyor supports the sheets on a cushion of air and carries them through the oven 10 in a substantially horizontal attitude.

The oven 10 further comprises a heating section 17, a cooling section 18 and an incinerator 19. In the heating section 17, heated air is ejected from a plenum chamber 20 so as to raise the metal sheets 15 to the required temperature. The fumes from the coating material are burnt in the incinerator 19. In the cooling section 18, cool air is injected from a pair of plenum chambers 21, 22. By way of modification, the heating and cooling sections may have additional plenum chambers.

One embodiment of a conveyor 16 and the plenum chamber 20 will now be described with reference to FIGS. 2 to 5.

Figure 3:
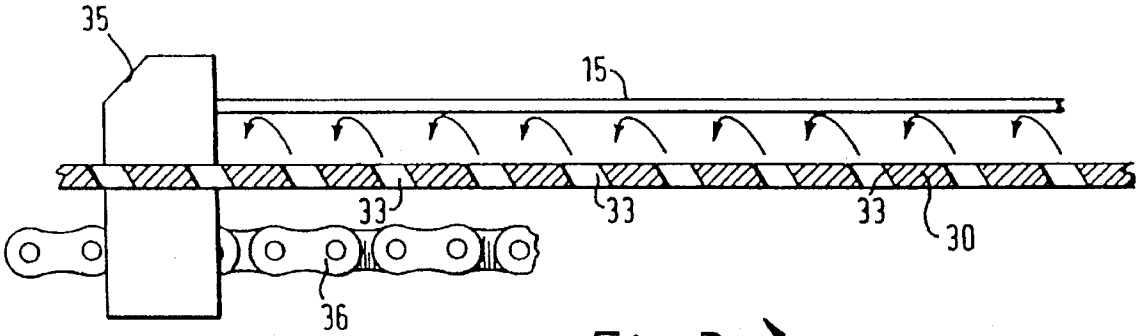
FIG. 3 is a longitudinal sectional view of part of the conveyor used in the oven of FIG. 1.
Figure 2:
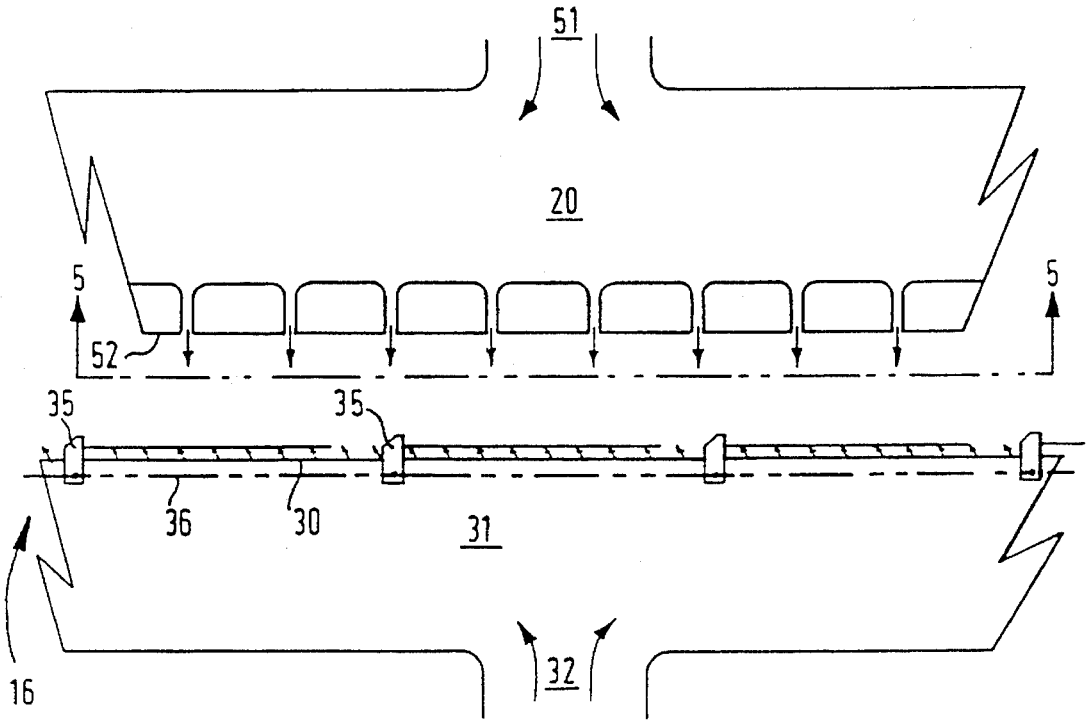
FIG. 2 is a diagrammatic side view of part of the heating section of the oven of FIG. 1 and shows one embodiment of a conveyor.
Figure 4:
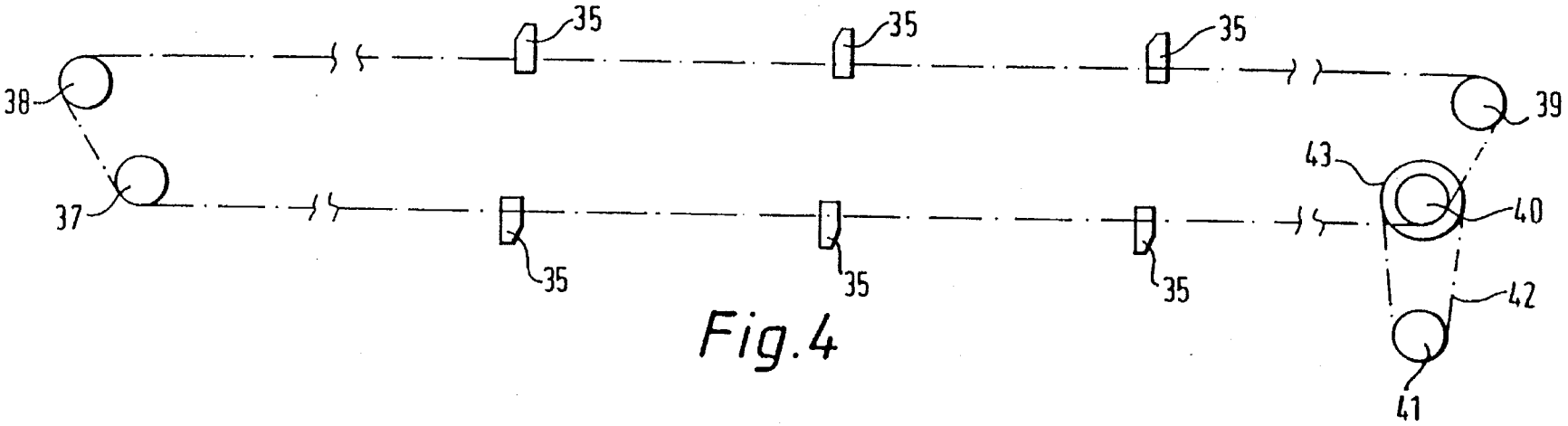
FIG. 4 is a diagrammatic view of drive members used in the conveyor.

Referring now to FIGS. 2, 3 and 4, the conveyor 16 includes an elongate air bed 30 which extends between the coating apparatus 12 and the sheet stacker 13. In the heating section, the air bed 30 is mounted on a plenum chamber 31 which has an inlet 32. In the cooling section, the air bed 30 is mounted on a separate plenum chamber.

A matrix of jets 33 are formed in air bed 30. In operation, pressurized air is supplied to the plenum chamber 31 and the jets 33 inject air into the space above air bed 30 so as to form a cushion of air for supporting the sheets 15. In order to propel the sheets 15 through the oven 10, the conveyor 16 includes two series of drive members 35. Each series of drive members 35 is mounted on a respective endless chain 36. The endless chains 36 are spaced apart laterally and the drive members 35 pass through grooves formed in the air bed 30. In FIGS. 2, 3 and 4, only one series of drive members 35 and a single endless chain 36 are shown. As shown in FIG. 4, each of the endless chains 36 passes over a pair of pulleys 37, 38 adjacent the coating apparatus 12 and over a further pair of pulleys 39, 40 adjacent the sheet stacker 13. The two pulleys 40 are mounted on a common shaft which is driven by an electric motor 41 via a drive chain 42 and drive pulley 43.

As shown in FIG. 3, the jets 33 are inclined rearwardly with respect to the direction of travel of sheets 15 along the conveyor. Consequently, the air ejected by jets 33 urges the sheets 15 against the drive members 35, which engage the trailing edges of sheets 15. With this arrangement, it has also been found that the sheets 15 are carried through the oven 10 in a stable manner and at spaced intervals which are controlled by the spacing of the drive members 35.

The air bed 30 may be horizontal or, alternatively, slope upwardly with progression through the oven 10. If the air bed 30 slopes upwardly, contact between the sheets 10 and drive members 35 is assisted by gravity.

Figure 5:
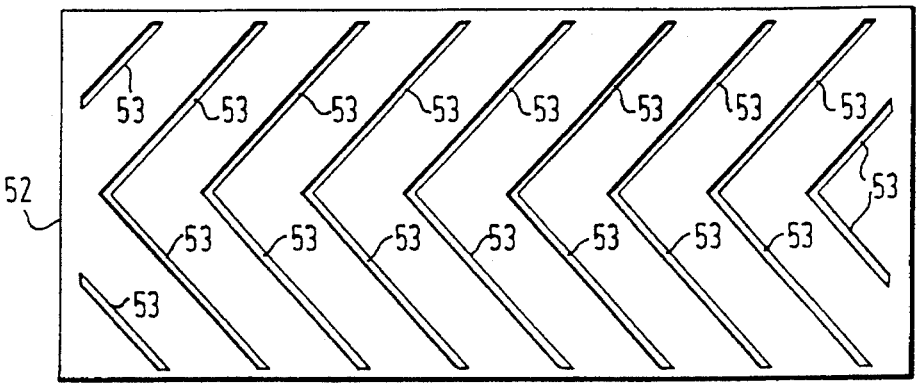
FIG. 5 is a view on line 5—5 of FIG. 2.

Referring now to FIGS. 2 and 5, the plenum chamber 20 has an inlet 51 and a lower wall 52. Heated air is supplied to the inlet 51 and this air is ejected through slots 53 formed in lower wall 52. As may be seen from FIG. 5, each of the slots 53 is oriented so that its projection onto the bed 30 is inclined by approximately 45° to the direction of travel of the sheets 15. With the slots 53 oriented in this manner, it has been found that there is no significant tendency for the air ejected through the slots to induce vibrations in or disturbance of the sheets 15. As may be seen in the present example, the slots 53 are arranged in pairs, the two slots of each pair being arranged to present a V-shape or chevron profile. By way of modification, the slots 53 may be replaced by perforations in lower wall 52.

The plenum chambers 21, 22 have a similar construction to that of plenum chamber 20.

Figure 6:
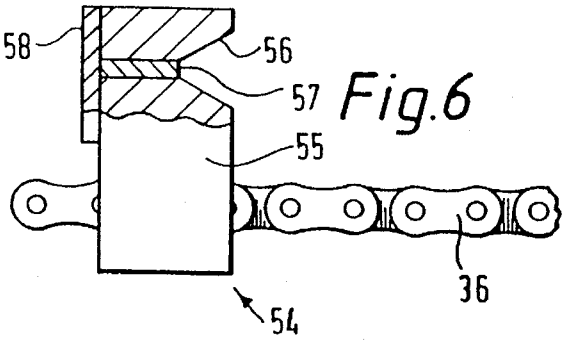
FIG. 6 is a fragmentary view, partly in section, of a modified drive member for the conveyor.

Referring now to FIG. 6, there is shown a modification to the drive members 35. FIG. 6 shows a single modified drive member 54 together with a short length of the drive chain 36. The modified drive member 54 comprises an aluminium body 55 having a V-shaped cutout 56 which provides positive location of metal sheets. Three transverse bores are formed in the body 55 between the apex of the cut-out 56 and the opposite side of the body 55. Each of these bores contains a bar magnet, one of which is shown and designated by reference numeral 57. The magnets are provided with a steel keeper 58. When the drive member 54 is propelling a steel sheet, the magnets 57 help to keep the steel sheet in contact with the drive member 54.

An alternative and preferred embodiment of a conveyor 200 for the oven 10 together with the plenum chamber 20 will now be described with reference to FIGS. 7 to 13.

Referring to FIGS. 7 to 11 the conveyor 200 includes a horizontal air bed 201 which extends from just inside the entrance of heating section 17 to just inside the exit of cooling section 18. In the heating section 17, the air bed 201 is mounted on a plenum chamber 202 which has an inlet 203. In the cooling section 18, the air bed is mounted on separate plenum chamber.

A matrix of upwardly directed jets 204 are formed in the air bed 201. In operation, pressurized air is supplied to the plenum chambers and the jets 204 inject air into the space above the air bed 200 so as to form a cushion of air for supporting the sheets 15.

In order to propel the sheets 15 through the oven 10, the conveyor 200 includes two series of drive members 205, 206. Each of the drive members 205, 206 extends across the entire width of the air bed 201 and is of V-shape in cross-section. The drive members 205, 206 are arranged in pairs. In each pair, the drive member 205 is arranged to engage the trailing edge of a sheet 15 while its leading edge is engaged by a drive member 206. Thus, in each pair, the drive members 205, 206 are spaced apart by a distance equal to the length of the sheets 15.

The ends of the drive members 205 are mounted on a pair of laterally spaced apart chains 208. Similarly, the drive members 206 are mounted on a pair of laterally spaced apart chains 209. The ends of the drive members 205 are cranked to permit them to bridge the chains 209. For most of their length, the chains 208, 209 are parallel so that only one of them is visible in the drawings (except for FIG. 11 in which all four chains are visible).

Figure 7:
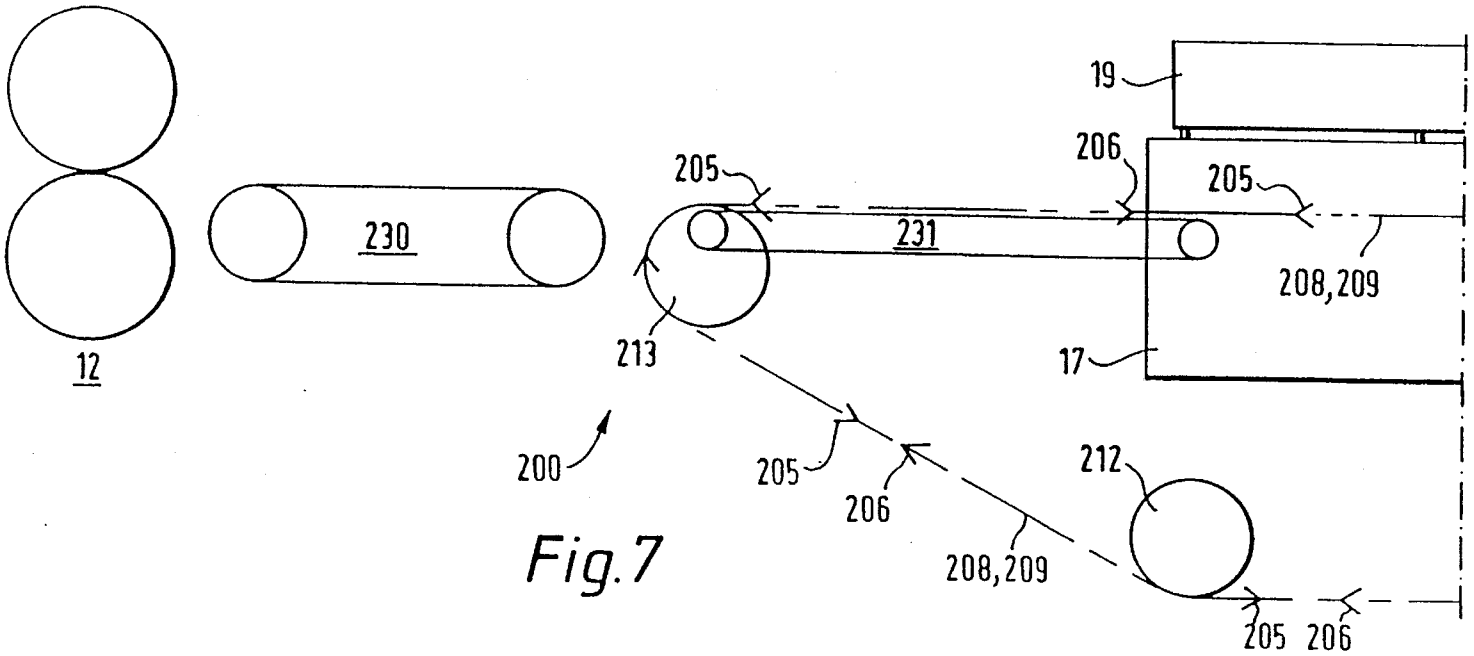
FIG. 7 is a diagrammatic side view of the front part of the oven of FIG. 1 showing an alternative embodiment of the conveyor.

As shown in FIG. 7, beneath the entrance of the heating section, the chains 208, 209 pass over a single pulley 212. The chains 208, 209 then pass over a pulley 213 before entering the heating section 17.

Figure 8:
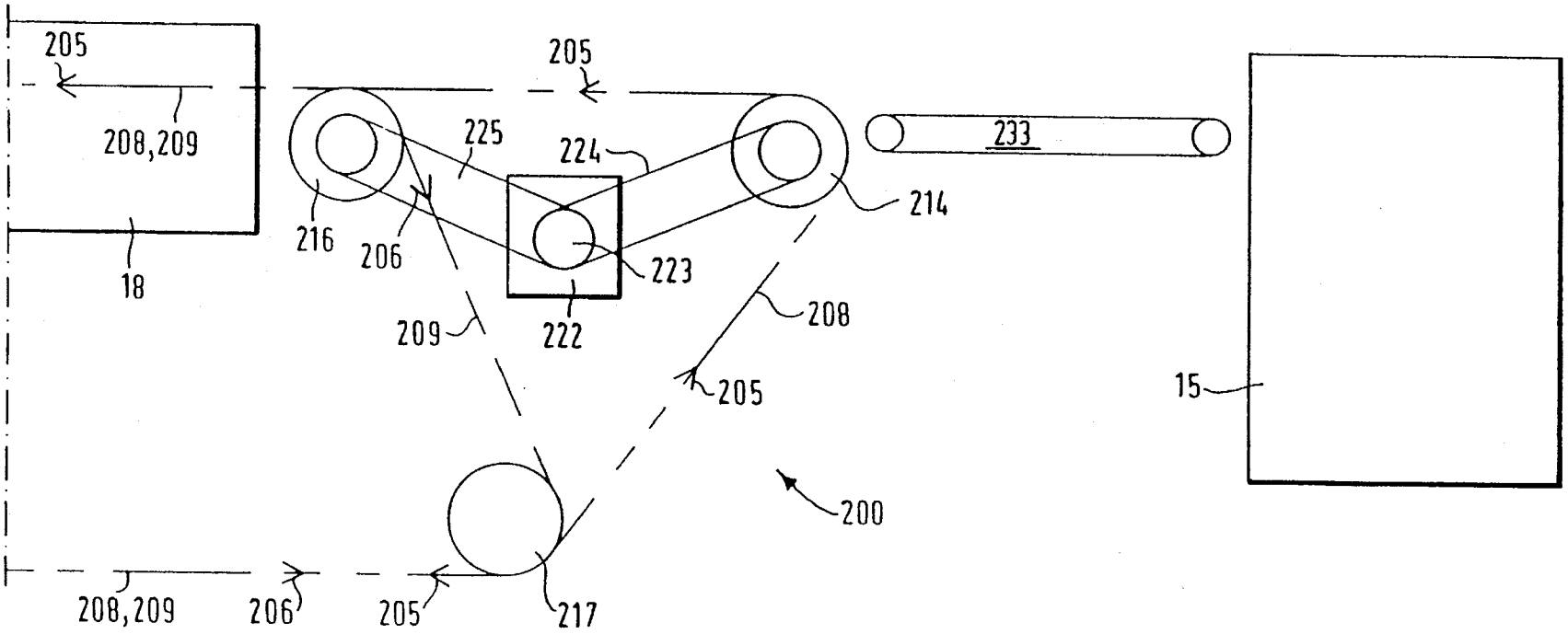
FIG. 8 is a diagrammatic side view of the rear part of the oven of FIG. 1 provided with the alternative conveyor.

As shown in FIG. 8, after passing through the exit of the cooling section 18, the chains 208 pass over a pulley 214 and the chains 209 pass over a pulley 216. After passing over pulleys 214, 216, all four chains 208, 209 pass over a common pulley 217. Between the pulleys 217 and 212, the chains 208, 209 pass over a series of pulleys, not shown.

In order to drive the chains 208, 209, there is provided a combined motor and gear box unit 222 which has a drive pulley 223. The drive pulley 223 drives pulleys 214, 216 respectively via belts 224, 225. The pulleys 214, 216 are driven at the same speed and, consequently the chains 208, 209 also travel at the same speed. The belt 224 may be disconnected from the motor of unit 222 to adjust the spacing between each pair of drive members 205, 206. The chains 208 are longer than the chains 209 by a distance equal to the spacing between two adjacent drive members 205 or 206.

Referring now to FIGS. 7 and 8, between the coating apparatus 12 and the pulley 213, the metal sheets are transported on the upper run of an endless belt conveyor 230. Between the pulley 213 and the beginning of the air bed 201, the central parts of the sheets are supported on the upper run of an endless belt conveyor 231. The upper run of the endless belt conveyor is slightly higher than the apexes of the drive members 205, 206 while the apexes of the drive members 205, 206 are slightly above the upper run of the endless belt conveyor 231. The metal sheets are carried from the pulley wheels 214, 216 to the sheets stacker 15 by an endless belt conveyor 233. The upper run of the endless belt conveyor is slightly below the apexes of drive members 205, 206. A further endless belt conveyor may be provided to support the sheets 15 between the end of the air bed 201 and the pulleys 214, 216.

The engagement of a sheet 15 by a pair of drive members 205, 206 is illustrated in FIGS. 12(*a*) to 13(*e*). These figures view the oven 10 from the opposite side to that of FIG. 1. The endless belt conveyor 230 runs at a slightly greater speed than the chains 208, 209. Consequently, as shown in FIGS. 12(*a*) to 12(*e*), the leading edge of the sheet 15 is brought firmly into engagement with the drive member 206.

Figure 9:
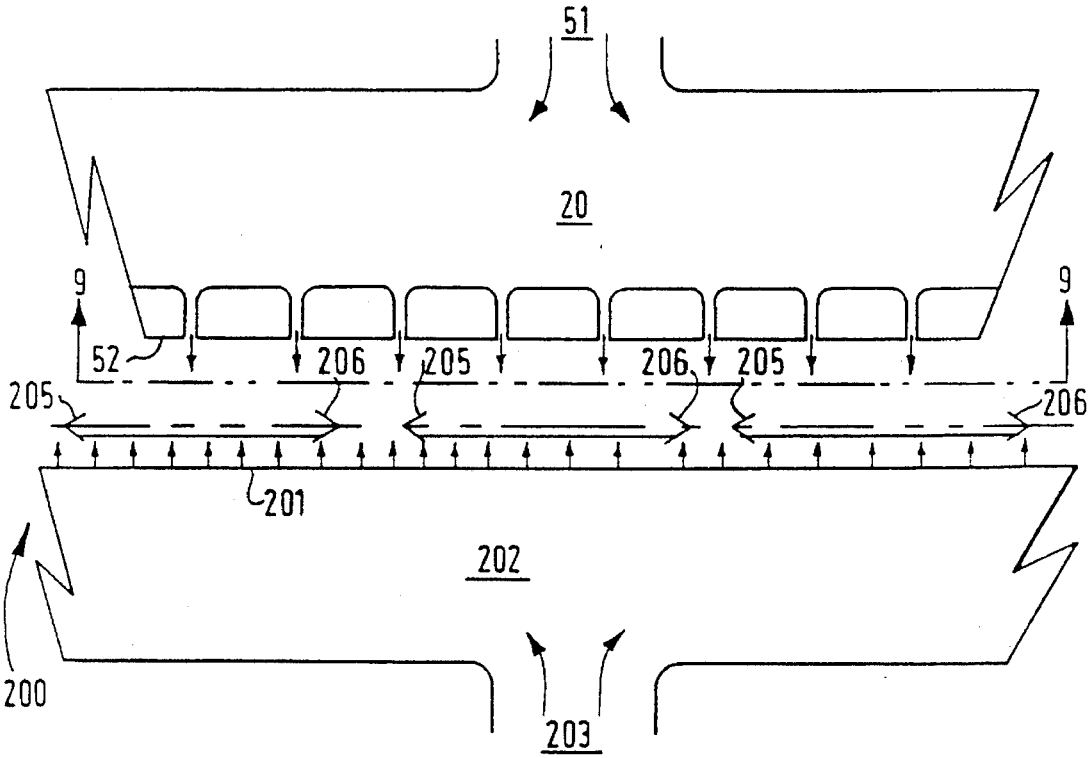
FIG. 9 is a diagrammatic side view of part of the heating section of the oven of FIG. 1 provided with the alternative conveyor.
Figure 10:
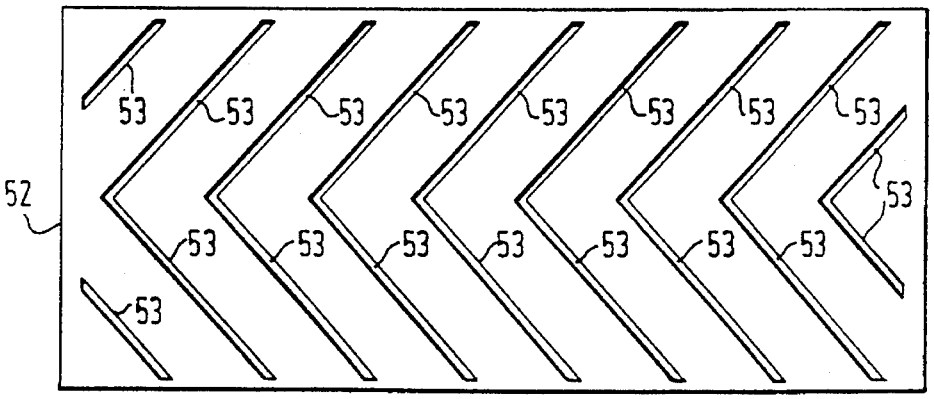
FIG. 10 is a view on line 9—9 of FIG. 9.
Figure 11:
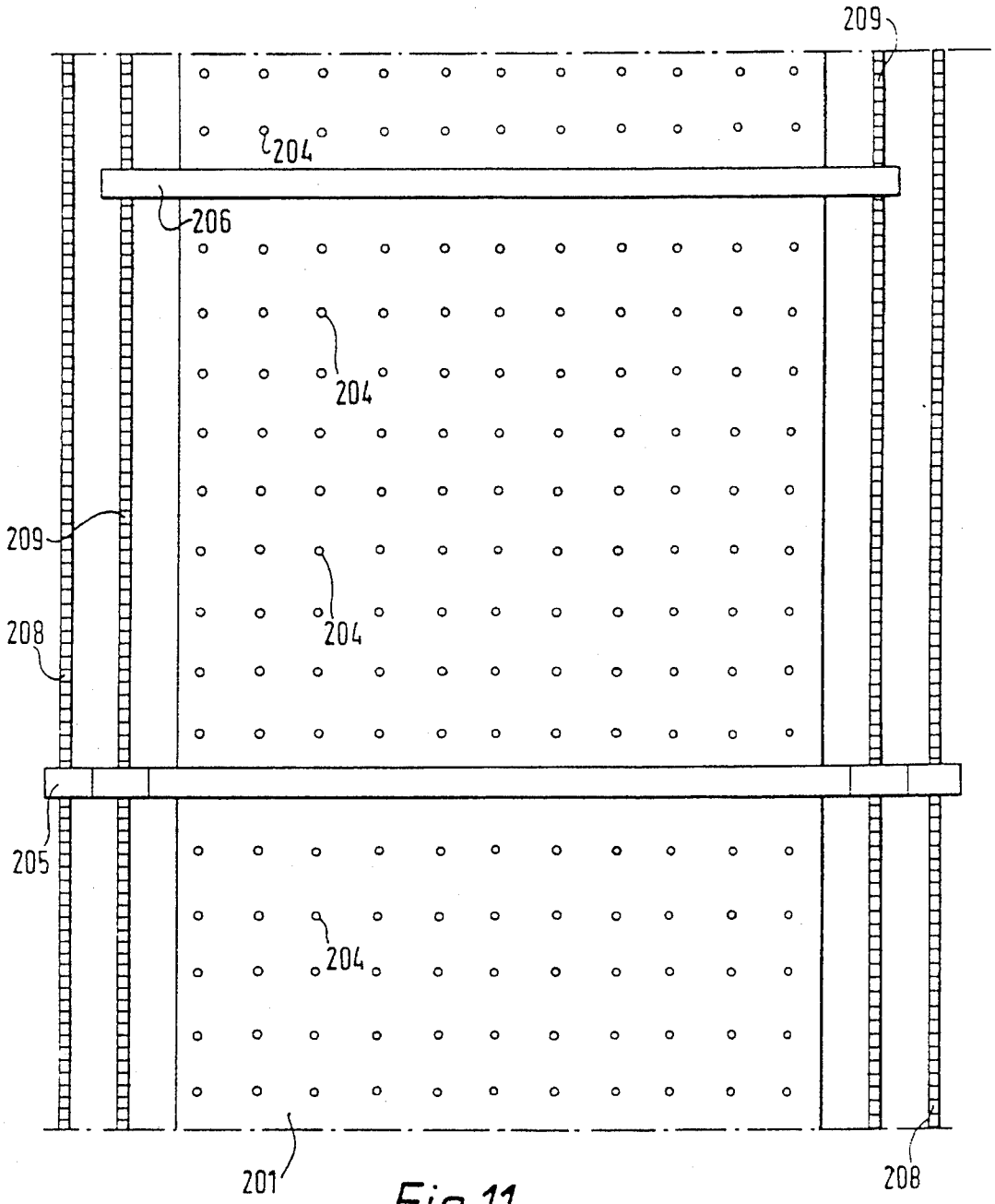
FIG. 11 is a fragmentary plan view of the air bed of the oven of FIG. 1 when provided with the alternative conveyor and showing a pair of drive members and associated chains.
Figure 12A:
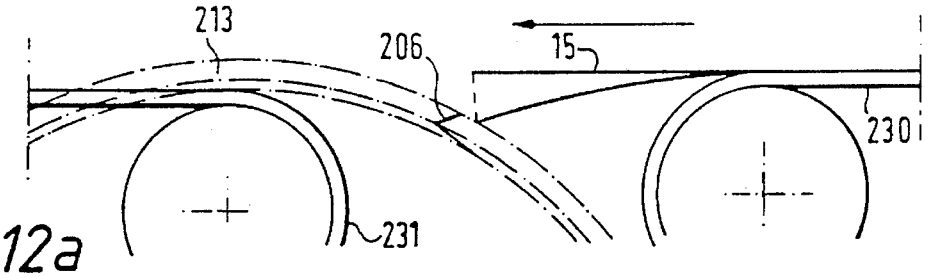
FIGS. 12(*a*) to 12(*e*) are diagrams illustrating the engagement of the leading edge of a metal sheet with a drive member of the alternative conveyor.
Figure 12B:
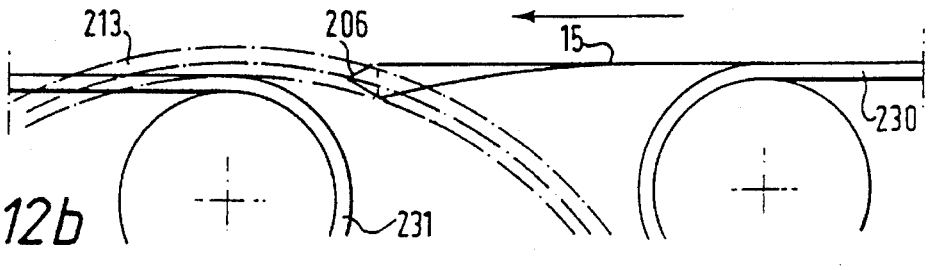
Figure 12C:
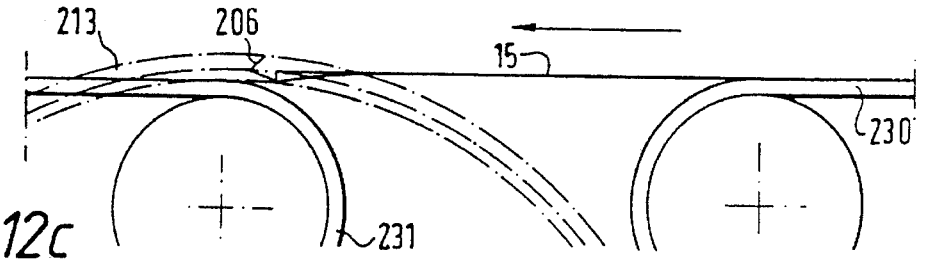
Figure 12D:
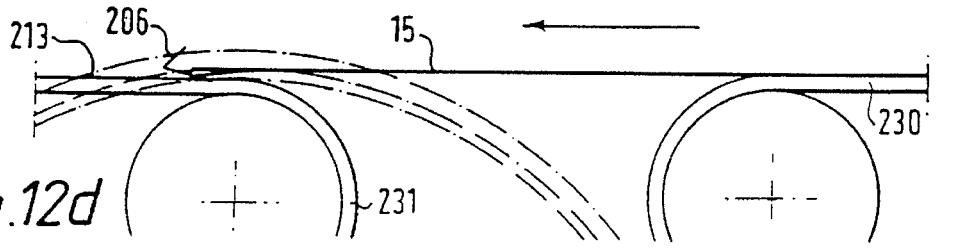
Figure 12E:
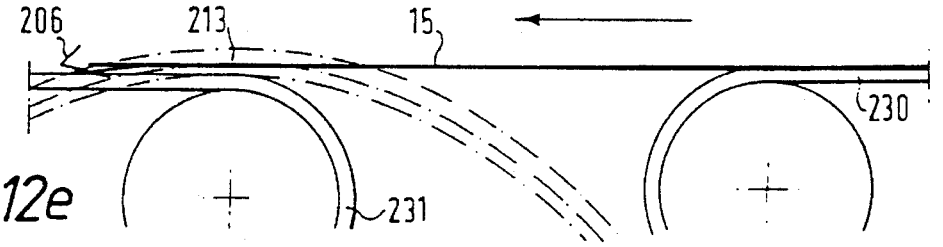
Figure 13A:
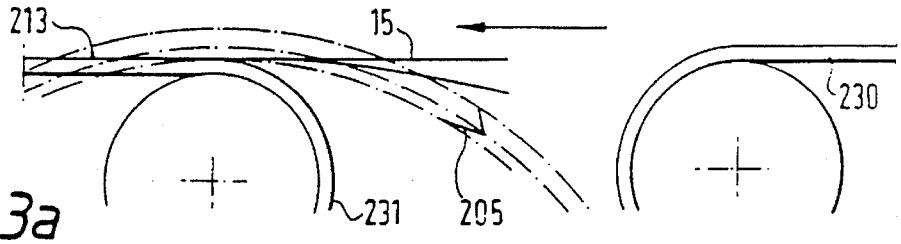
FIGS. 13(*a*) to 13(*e*) are diagrams illustrating the engagement of the trailing edge of a metal sheet with a drive member of the alternative conveyor.
Figure 13B:
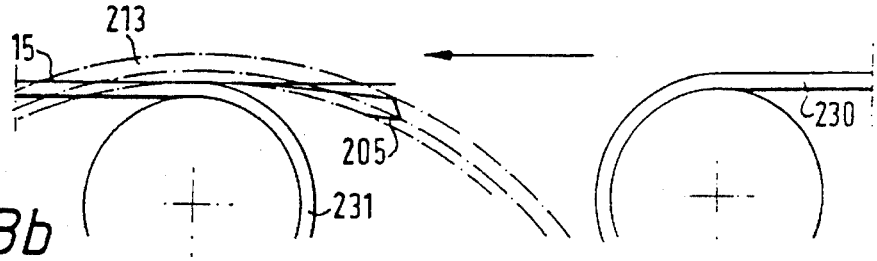
Figure 13C:
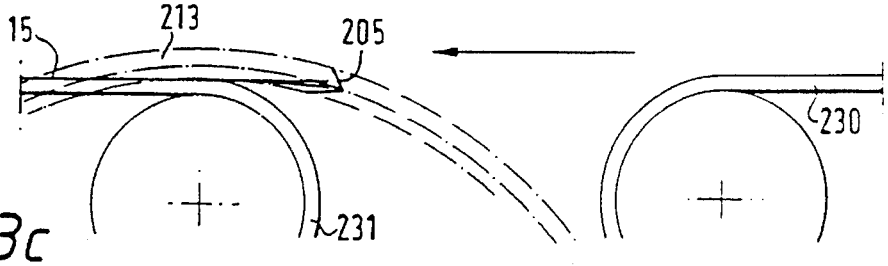
Figure 13D:
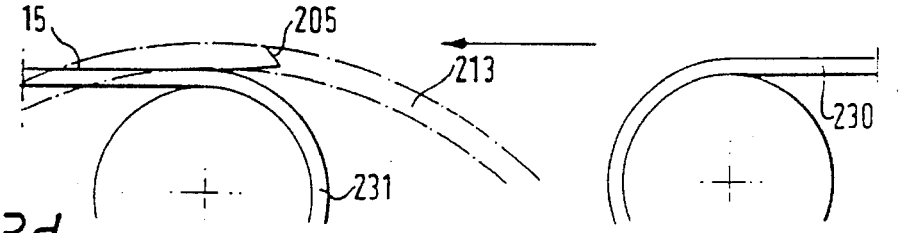
Figure 13E:
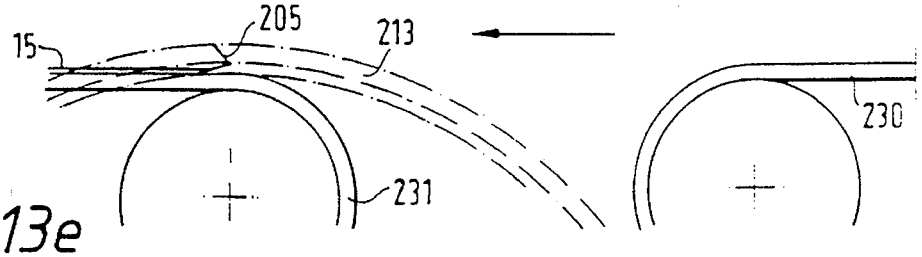

The plenum chamber 20 is shown again in FIGS. 9 and 10. By way of modification, when the oven 10 is provided with the conveyor 200 of FIGS. 7 to 11, the slots in the lower wall 52 of plenum chamber 20 may be transverse, that is inclined at 90° to the direction of travel of the sheets.

Figure 14:
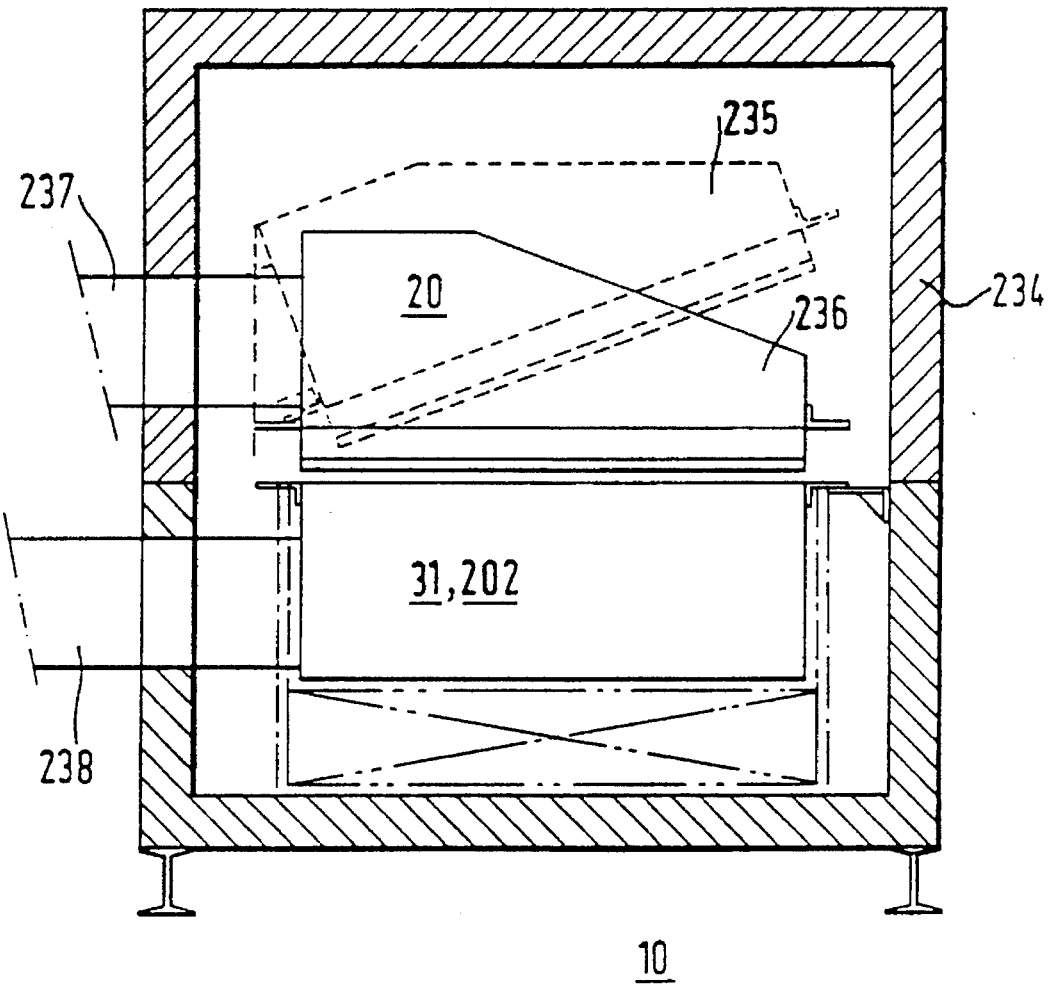
FIG. 14 is a cross-sectional view of the heating section of the oven of FIG. 1.

Referring now to FIG. 14, there is shown a cross-section of the heating section 17. As shown, the heating section has a wall 234 formed of insulating material which encloses the plenum chambers 20 and 31 or 202. Although not shown, the wall 234 has panels which may be removed to permit access to the interior of the heating section 11. The plenum chamber 20 is pivotally mounted to permit movement between its normal operating position, indicated by reference numeral 235, and a raised position, indicated by reference numeral 236. The plenum chamber 20 is moved to its raised position to permit access to the air bed. The plenum chambers 20 and 31 or 202 receive air through ducts 237, 238.

Figure 15:
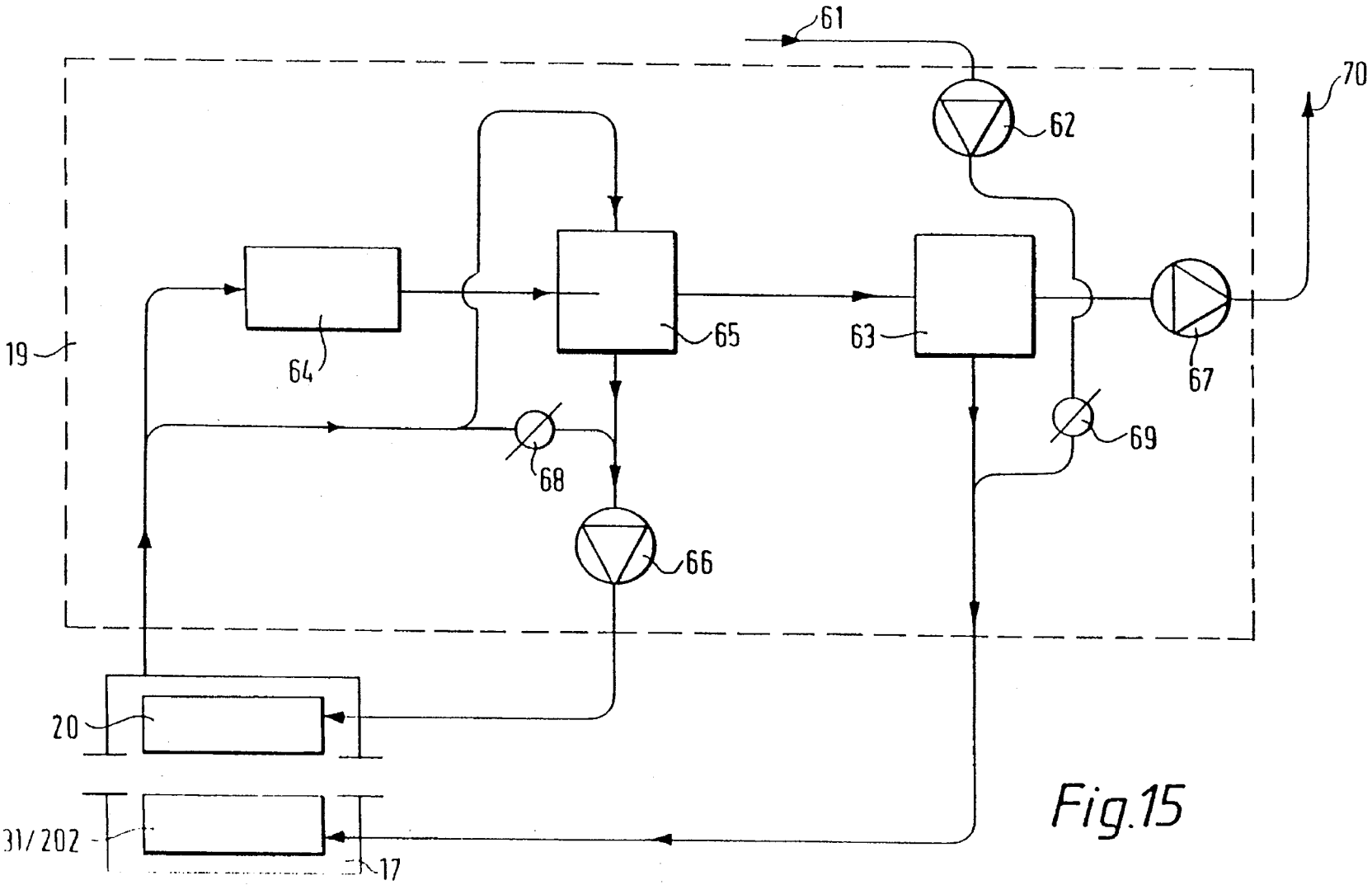
FIG. 15 is a circuit diagram of the arrangement for supplying heated air to the heating section of the oven of FIG. 1.

Referring now to FIG. 15 there is shown the circuit for supplying heated air to the plenum chambers 20 and 31 or 202. The circuit includes an air inlet 61, three fans 62, 66, 67, two heat-exchangers 63, 65, a combustion chamber 64, two by-pass control valves 68, 69 and an outlet 70. The components 61 to 70 form the incinerator 19.

Air from inlet 61 passes through fan 62 and the secondary side of heat exchanger 63 to the inlet of plenum chamber 31 or 201. Exhaust air from the heating section 17 is divided into two parts. The first part is supplied to the inlet of combustion chamber 64. The products of combustion pass through the primary sides of heat exchangers 65 and 63 and the fan 67 to the outlet 70. The second part passes through the secondary side of heat exchanger 65 and the fan 66 to the inlet of plenum chamber 20.

Thus, in the incinerator 19, the heat of combustion from the fumes is used to heat the air which is injected into both plenum chambers.

Figure 16:
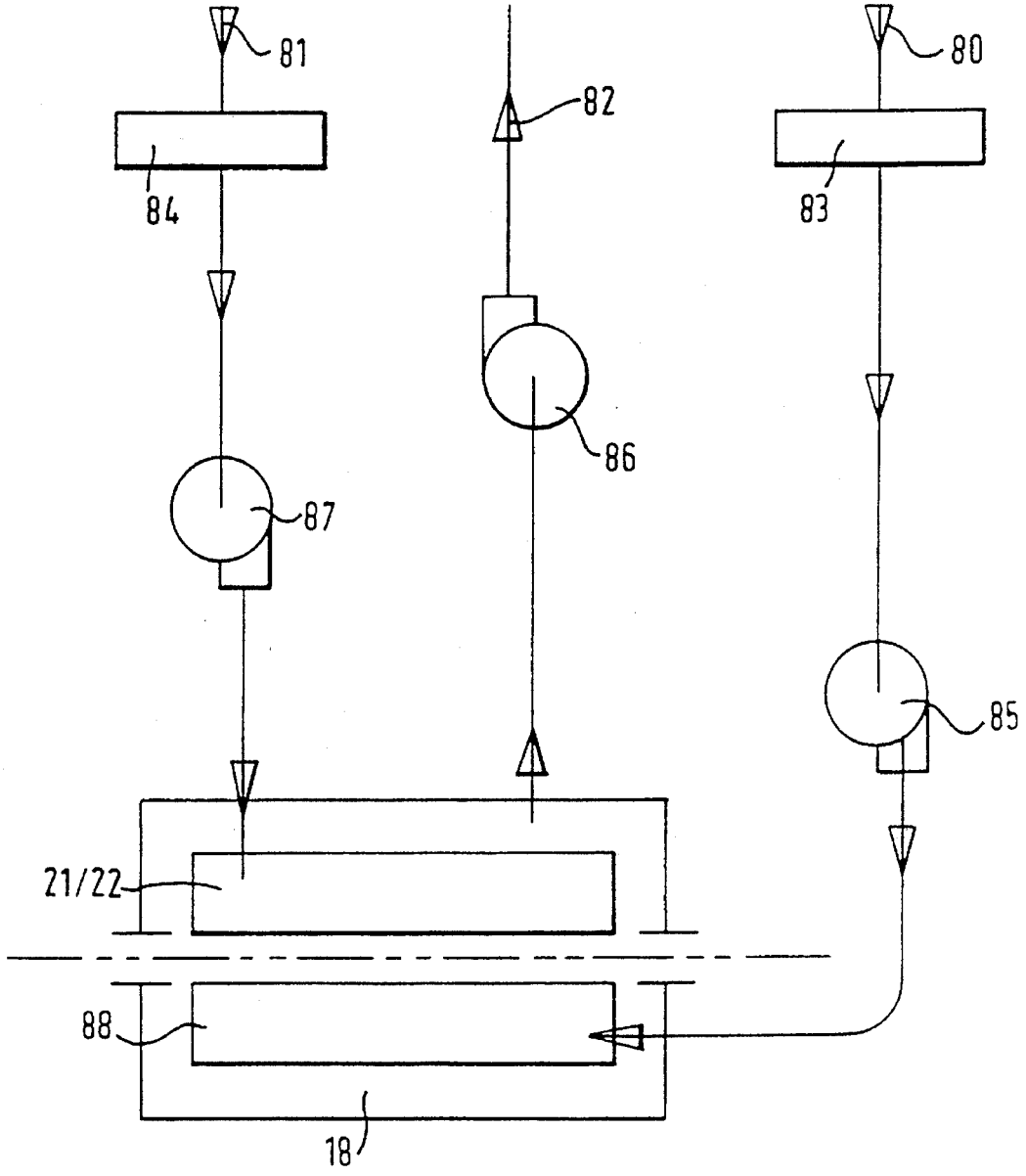
FIG. 16 is a circuit diagram of the arrangement used for supplying cool air to the cooling section of the oven of FIG. 1.

Referring now to FIG. 16, there is shown the circuit for supplying cool air to the plenum chambers 21, 22, 88 in the cooling section 18. Plenum chamber 88 is located beneath air bed 30 in the cooling section. This circuit includes a pair of inlets 80, 81, an outlet 82, a pair of filters 83, 84, and three fans 85, 86, 87.

Air from inlet 80 passes through filter 83 and fan 85 into the plenum chamber 88. Similarly, air from inlet 81 passes through filter 84 and fan 87 into plenum chambers 21, 22. Air is withdrawn from the cooling section 18 by fan 86 and ejected through outlet 82.

For some applications it may be desired to cure coating material in a gaseous atmosphere other than air. For example, it may be desired to cure coating material in an atmosphere of nitrogen or an inert gas. In order to cure coating material in an atmosphere of a particular gas, the gas is supplied to plenum chambers 20, 21, 22, 31 or 202 and 88 and incinerator 19 is replaced with a heater.

Figure 17:
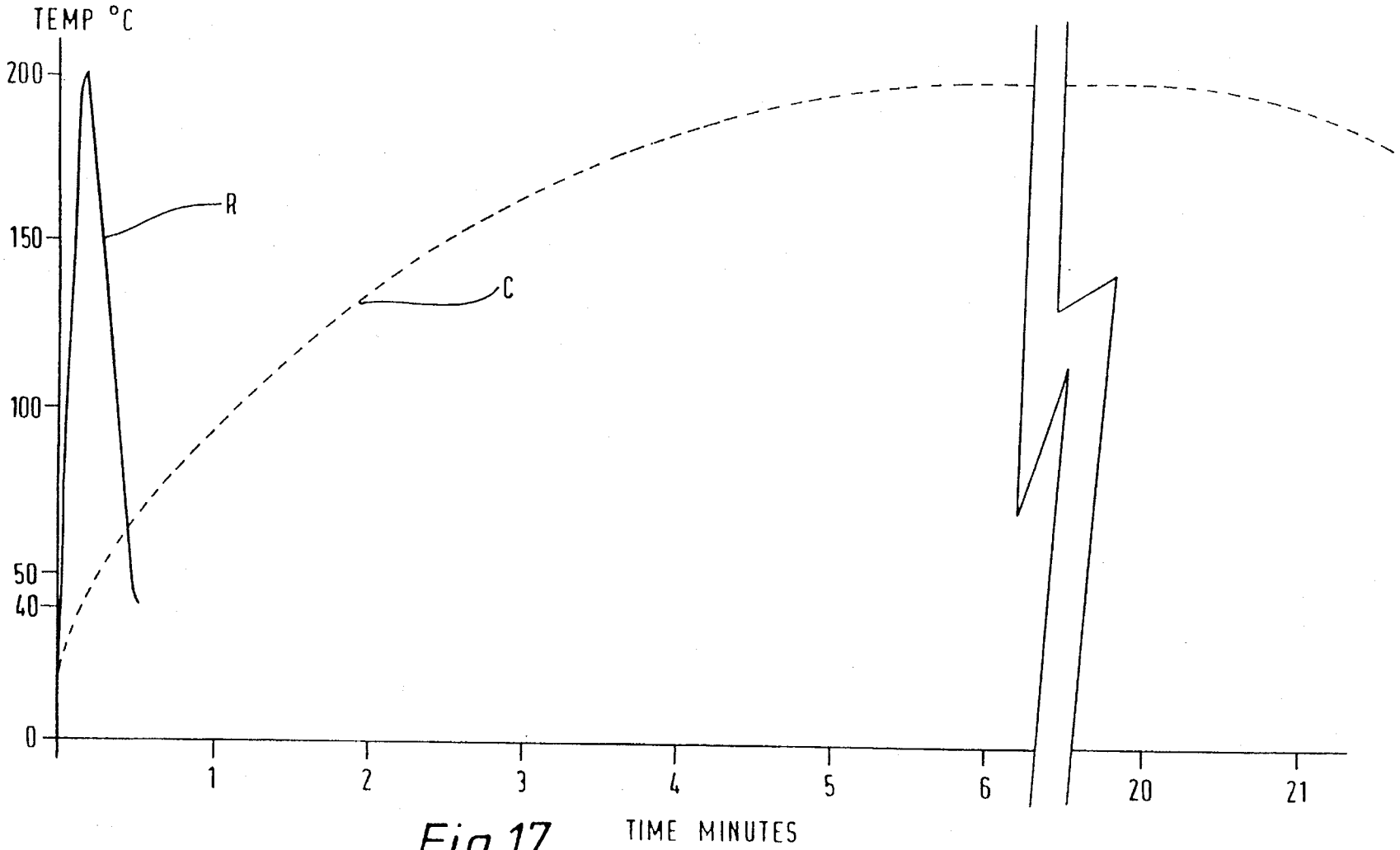
FIG. 17 shows graphs comparing the curing cycle of conventional and rapid cure materials.

When curing conventional coating materials in a conventional oven, the temperature of each sheet is raised over a period of five or six minutes to a temperature in the range of 120° C. to 230° C. and each sheet spends approximately 10 to 20 minutes in the heating section and 3 to 5 minutes in the cooling section. The first part of the curing cycle of a conventional coating material is shown in FIG. 17 by graph C.

For a particular oven, the rate of entry of sheets into the oven is limited by the capacity of the oven and the total time spent by each sheet in the oven. It is normal for approximately 5000 sheets/hour to enter a conventional oven. Because sheets enter the oven of FIGS. 1 to 16 in a horizontal attitude, it has a much lower capacity than a conventional oven of the same length. Consequently, if it were used to cure conventional coating material, the maximum rate of entry of sheets into the oven would be much lower than the rate achievable with a conventional oven of the same length.

There have been developed so called "rapid cure" coating materials. The applications for such coating materials presently include coil coating and coating of can bodies after they have been formed into the desired shape. These coating materials include lacquers, sizes, pigmented coatings, inks and varnishes. They are cured by rapid elevation to temperatures in the region of 180° C. or higher followed immediately by cooling. The curing cycle for a typical rapid cure coating material is shown by graph R in FIG. 17. As may be seen, the coating material is elevated to a peak temperature of 200° C. in about 8 seconds. It is then cooled to 40° C. in a further period of about 16 seconds. When the temperature has been reduced to below 40° C., the coating material is no longer tacky and can be handled without risk of damage. It is to be noted that the time required to cool the coating material is approximately double that required to heat it to its peak temperature. The use of refrigerated air would allow cooling times to be shortened.

The period of eight seconds for raising a rapid cure material to its peak temperature is quoted above only by way of example for a typical rapid cure material. The residence period in the heating section 17 will depend on the specific rapid cure material being used and, more generally, will lie in the range 4 to 60 seconds.

As a conventional oven is designed to provide lengthy transit times in the heating and cooling sections, such an oven would be unsuitable for use with rapid cure coating materials. However, in the oven described with reference to FIGS. 1 to 16, short transit times may be achieved. This oven is, therefore, suitable for use with rapid cure coating materials. When used with such materials, it is possible to achieve a rate of entry of sheets into the oven which is comparable to that achieved with a conventional oven of equal length using conventional coating materials. In the oven 10, the heated air from the plenum chamber 31 or 202 of the conveyor helps to raise the temperature of the sheets rapidly to the curing temperature. Similarly, in the cooling section, the air from the plenum chamber 88 of the conveyor helps to cool the sheets rapidly to the required cooling temperature.

As is normal in an oven, the oven 10 can cure coating material which has been applied just to the upper surface of sheets 15. However, because the upper and lower surfaces of each sheet are free from contact with any part of the oven as they pass therethrough, with a suitable arrangement for transferring sheets from the coating apparatus 12 to the air bed, the oven 10 can also be used to cure coating material which has been applied simultaneously to both surfaces of sheets 15. In order to coat both surfaces simultaneously, the coating apparatus 12 should be configured so that it has two coating cylinders. By applying coating material to both surfaces of sheets 15 and curing the coating by a single pass through the oven 10, the number of passes through oven is halved and the time and energy required to coat and cure the sheets is reduced.

Figure 18:
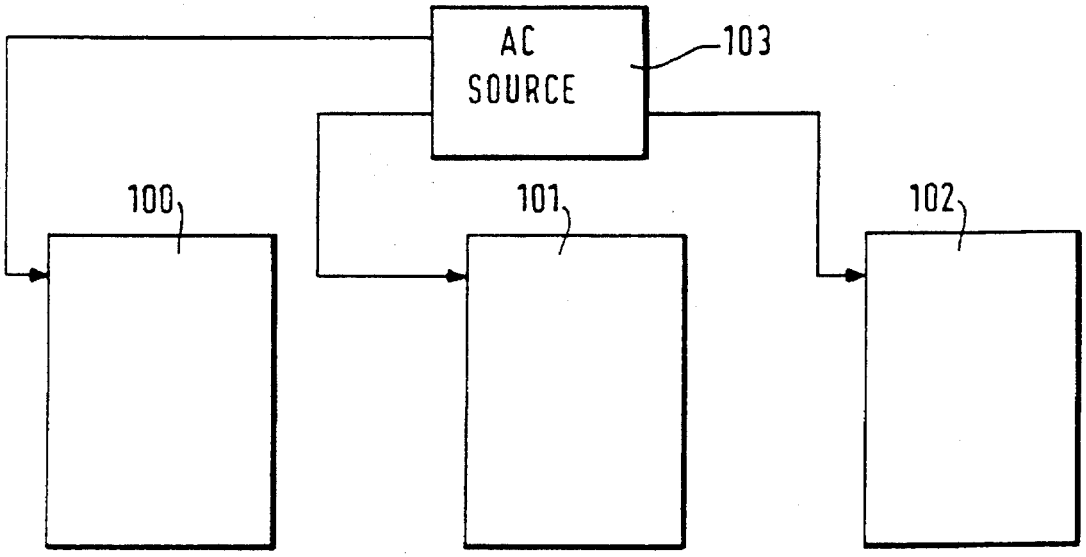
FIG. 18 is a block diagram of a modification to the heating section of the oven of FIG. 1 in which coating material is cured by induction coils.

Referring now to FIG. 18, there is shown a modification to the heating section 17 of oven 10. In this modification, the plenum chamber 20 is replaced by three induction heating coils 100, 101, 102 connected to an AC source 103. In a well known manner, the induction heating coils induce eddy currents in sheets 15 and thereby cause the temperature in the sheets to rise to the desired value. The coil 100 will be described with reference to FIG. 19.

Figure 19:
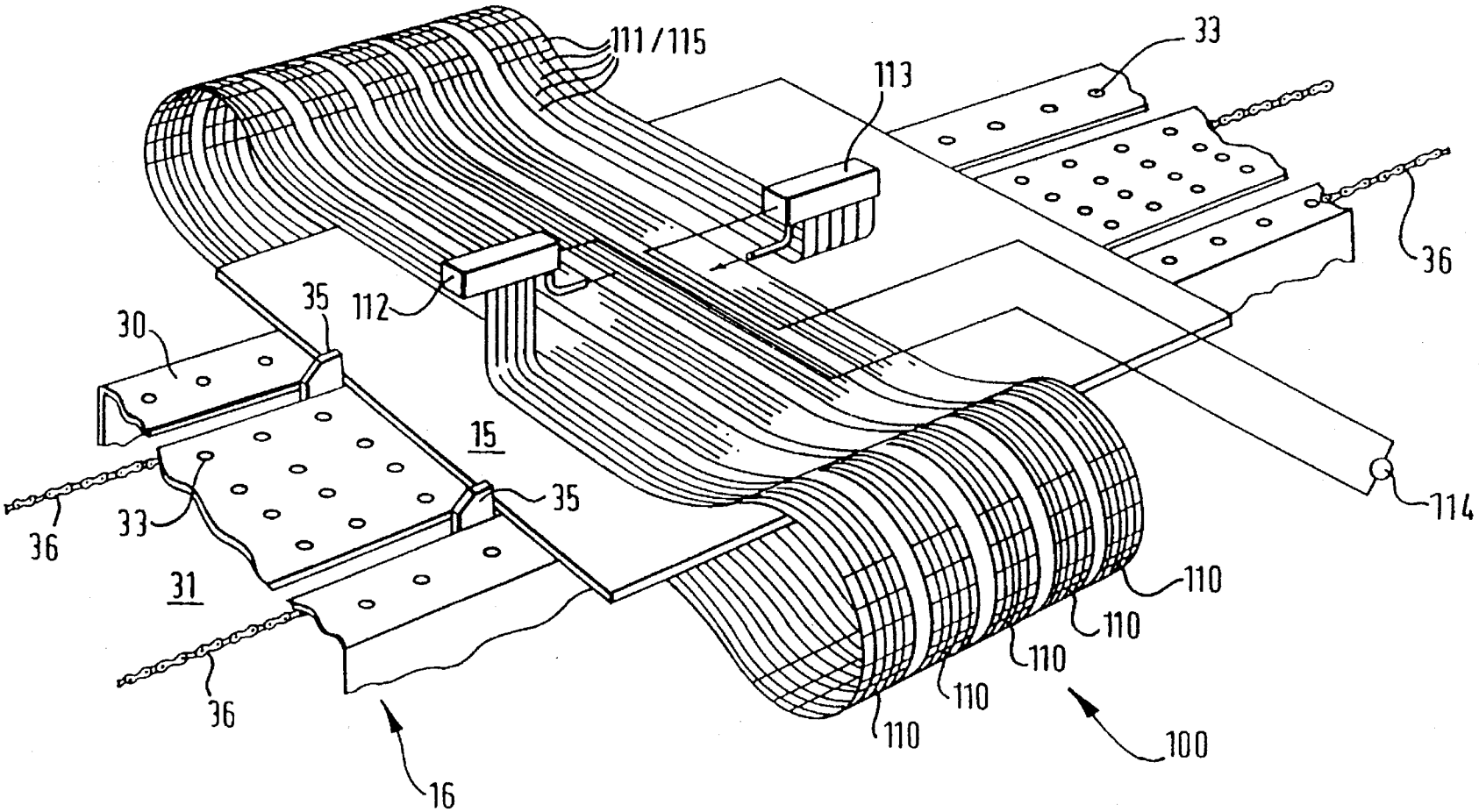
FIG. 19 is a perspective view of part of the heating section of the oven of FIG. 1 and shows the induction coils of FIG. 17.

Referring now to FIG. 19, the coil 100 is shown together with part of the conveyor 16. The drive members 35 are shown pushing a sheet 15 through coil 100. As may be seen, the bed 30 and drive member 35 also pass through coil 100. The lower part of coil 100 may pass through the side walls of plenum chamber 31 or beneath plenum chamber 31.

In order to avoid undesirable heating, the bed 30, walls of plenum chamber 31, drive members 35 and chain 36 are all made from an electrically insulating material.

The coil 100 has five turns 110. Each of the turns 110 comprises flexible copper conductors 111 which are connected electrically and mechanically at terminals 112, 113. These terminals are connected to a source 114 of alternating current. The frequency of the alternating current is chosen according to the requirements of the coating material and metal sheets and will, typically, be in the range 5 kHz to 500 kHz. The power delivered into the metal sheets should be such that the temperature rise of the sheets does not exceed 200° C./second.

Each of the conductors 111 is enclosed within a flexible pipe 115 formed from electrically-insulating plastics material. The pipes 115 are also connected together in terminals 112, 113 and the terminals 112, 113 are then connected to a source of cooling water.

As may be observed in FIG. 19, the spacing between the conductors 111 and the sheets 15 is increased adjacent the side edges. The spacing is increased in this manner so as to prevent the side edges of sheets 15 from achieving a temperature higher than that achieved in their central parts. The conductors 111 and pipes 115 are held in the position shown in FIG. 19 by a support structure, not shown.

The use of induction coils 100, 101, 102 provides advantages over the plenum chamber 20. By the use of induction heating, the temperature in the sheet 15 can be elevated more quickly to the required curing temperature. This helps to reduce the transit time required in the oven 10. Also, the use of induction heating ensures that both surfaces of the sheets 15 are raised equally to the required curing temperature. The induction coils are particularly suitable for curing both surfaces of sheets 15 simultaneously. By way of modification, the induction coils 100, 101, 102 may be used together with plenum chamber 20.

With the shape shown in FIG. 19, the coil 100 is suitable for use with steel sheets. As known in the art, if aluminium sheets are to be induction heated, the sheets are passed between upper and lower coils which deliver a transverse flux.

Figure 20:
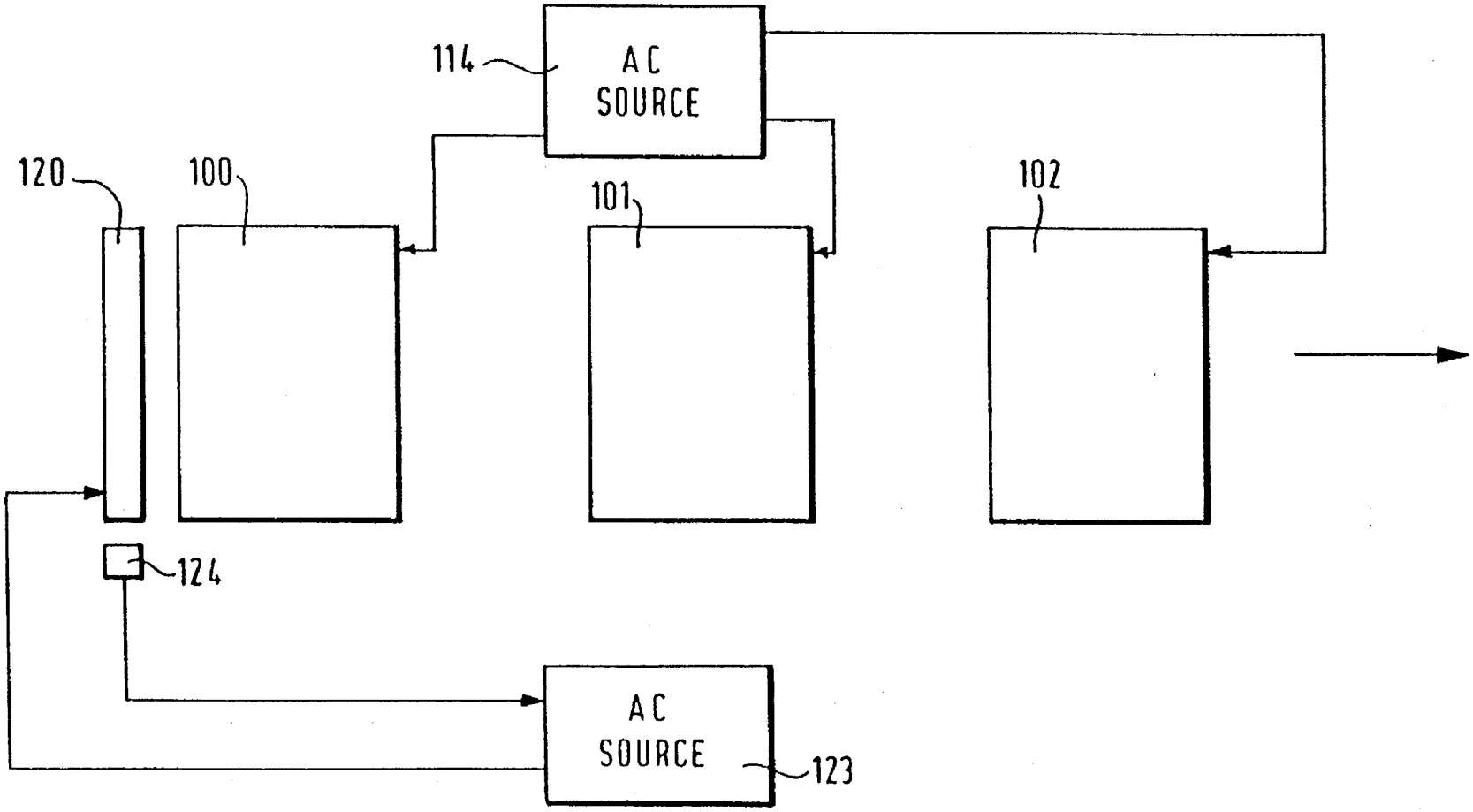
FIG. 20 is a block diagram of another arrangement of induction coils for use in the heating section of the oven of FIG. 1.
Figure 21:
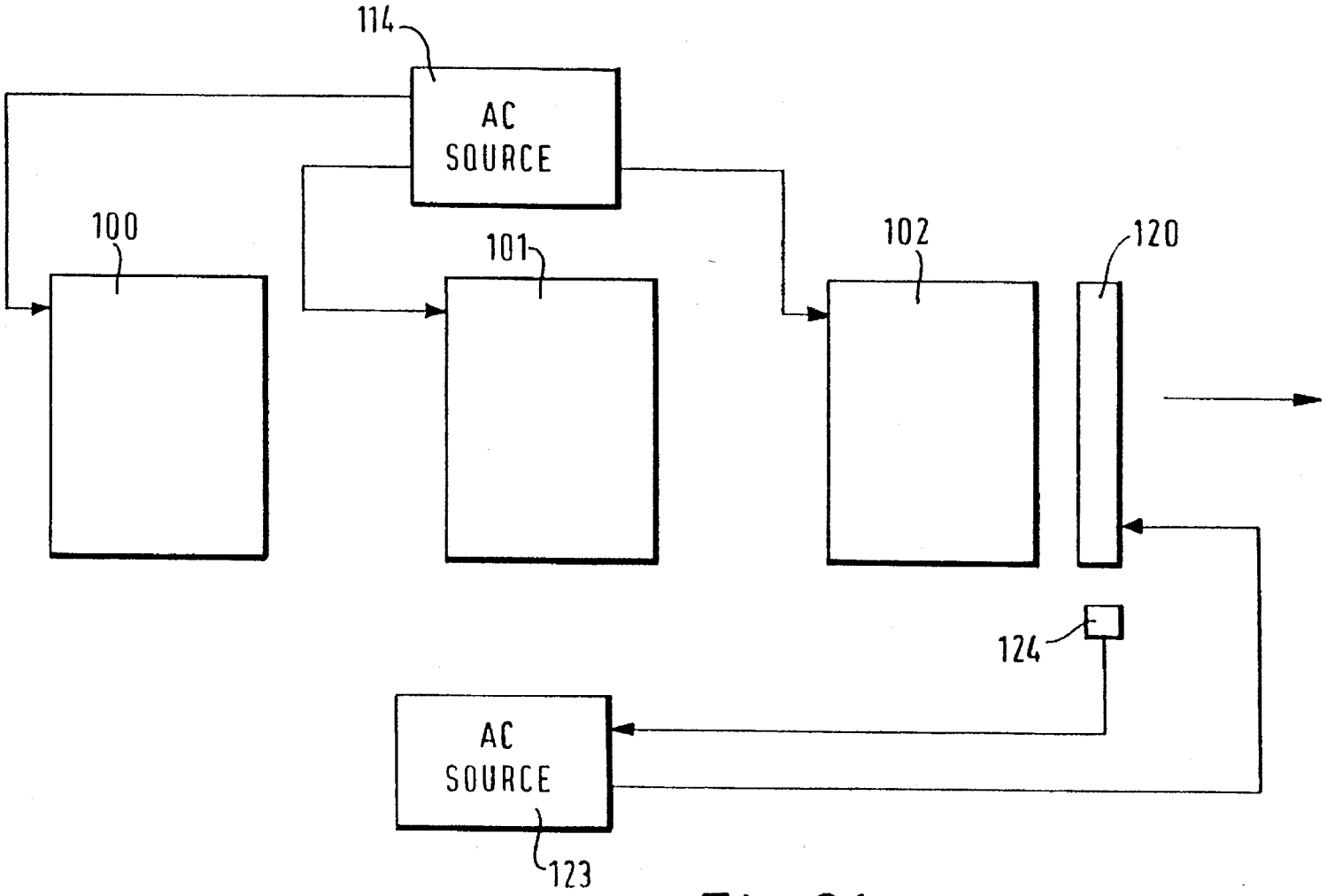
FIG. 21 is a block diagram of a further arrangement of induction coils for use in the heating section of the oven of FIG. 1.

With the induction coils 100, 101, 102, the leading and trailing edges of the sheets 15 achieve a lower temperature than that achieved in their central parts. In some coating materials, this temperature difference may lead to incomplete curing. With reference to FIGS. 20 and 21, there will now be described two modified arrangements which overcome this problem.

In the modified arrangement of FIG. 20, the induction coil 100 is preceded by an auxiliary induction heating coil 120. The coil 120 is connected to an AC source 123. The auxiliary coil 120 is associated with a position detector 124. The detectors 124 detect the passage of the leading and trailing edges of sheets 15 through the coil 100 and this detector is connected to a control circuit in the AC source 123. The control circuit is arranged to energize the coil 120 each time a leading or trailing edge of one of the sheets 15 passes through it with a short pulse of high frequency alternating current. A suitable frequency for this purpose is 100 to 500 kHz. The AC source 123 should operate at a higher frequency than the AC source 114. The auxiliary heating coil ensures that the leading and trailing edges of the sheets 15 achieve a temperature which is close to that achieved in the central parts of the sheets.

The arrangement shown in FIG. 21 is identical to that shown in FIG. 20 with one exception. The auxiliary coil 120 and its associated detector 124 are placed after coil 120. In both FIGS. 20 and 21, the direction of travel of the sheets is indicated with an arrow.

In the arrangements shown in FIG. 20, the temperature of each sheet is raised in a narrow zone adjacent the leading and trailing edges by the pulses of energy received from the auxiliary coil. As the sheet passes through coil 100, heat is conducted away from the narrow zone and a more even temperature distribution is achieved. Thus, the arrangement of FIG. 20 has this advantage over the arrangement of FIG. 21. However, in the arrangement of FIG. 12, the temperature of a sheet adjacent its leading and trailing edges may be monitored before each edge passes through coil 120 and the energy of the pulse from coil 120 may be adjusted accordingly.

We claim:

1. An oven for curing coating material that has been applied to a plurality of metal sheets, said oven comprising a heating section for applying heat to the metal sheets, wherein the heating section comprises at least one main induction coil, an auxiliary induction coil, first current supplying means for supplying continuous alternative current to the or each main induction coil, and second current supplying means for supplying pulses of alternating current to the auxiliary induction coil, the second current supplying means being arranged so that the auxiliary induction coil receives a current pulse as each of the leading and trailing edges of a metal sheet passes therethrough; and a conveyor for conveying the metal sheets through the heating section along a direction of travel, wherein the conveyor comprises: an elongated bed extending through the heating section, a plenum chamber located beneath the bed, a matrix of jets formed in the bed for supplying gas from the plenum chamber to the space above the bed so as to form a gas cushion, the gas cushion being capable of supporting the metal sheets, and means for propelling the metal sheets along the bed.

2. An oven for curing coating material that has been applied to a plurality of metal sheets, said oven comprising a heating section for applying heat to the metal sheets, and a conveyor for conveying the metal sheets through the heating section along a direction of travel, wherein the conveyor comprises: an elongated bed extending through the heating section, a plenum chamber located beneath the bed, a matrix of jets formed in the bed for supplying gas from the plenum chamber to the space above the bed so as to form a gas cushion, the gas cushion being capable of supporting the metal sheets, and means for propelling the metal sheets along the bed; wherein the propelling means comprises at least one endless line extending through the heating section, means for imparting motion to said at least one endless line, a first series of drive members mounted on said at least one endless line at spaced apart intervals, said first series of drive members being arranged to engage the leading edges of metal sheets passing along the conveyor, and a second series of drive members mounted on said at least one endless line at spaced apart intervals, said second series of drive members being arranged to engage the trailing edges of metal sheets passing along the conveyor; and wherein said at least one endless line comprises at least one pair of laterally spaced apart endless lines, the individual drive members of said first series of drive members are mounted on, and extend between, the two laterally spaced apart endless lines of said pair of endless lines, and the individual drive members of said second series of drive members are mounted on, and extend between, the two laterally spaced apart endless lines of said pair of endless lines.

3. An oven for curing coating material that has been applied to a plurality of metal sheets, said oven comprising a heating section for applying heat to the metal sheets, and a conveyor for conveying the metal sheets through the heating section, wherein the conveyor comprises: an elongated bed extending through the heating section, a plenum chamber located beneath the bed, a matrix of jets formed in the bed for supplying gas from the plenum chamber to the space above the bed so as to form a gas cushion, the gas cushion being capable of supporting the metal sheets, and means for propelling the metal sheets along the bed; wherein the propelling means comprises: at least one endless line extending through the heating section, means for imparting motion to said at least one endless line, a first series of drive members mounted on said at least one endless line at spaced apart intervals, said first series of drive members being arranged to engage the leading edges of metal sheets passing along the conveyor, and a second series of drive members mounted on said at least one endless line at spaced apart intervals, said second series of drive members being arranged to engage the trailing edges of metal sheets passing along the conveyor; and wherein said at least one endless line comprises first and second pairs of endless lines, the individual drive members of said first series of drive members are mounted on, and extend between, the two laterally spaced apart endless lines of said first pair of endless lines, and the individual drive members of said second series of drive members are mounted on, and extend between, the two laterally spaced apart endless lines of said second pair of endless lines.

4. An oven as claimed in any one of claims 2 or 3, in which the individual drive members of said first and second series of drive members have a V-shape in cross-section.

5. An oven as claimed in any one of claims 2 or 3, further comprising a first endless belt conveyor positioned upstream from said at least one endless line, said first endless belt being arranged to bring the metal sheets sheets into engagement with the first and second series of drive members, and a second endless belt conveyor extending along a portion of the at least one endless line between said first endless belt and the bed, said second endless belt being arranged to provide additional support for the metal sheets as the metal sheets pass along said at least one endless line upstream of the bed.

6. An oven as claimed in claim 1 or or claim 2, in which the heating section includes a second plenum chamber having a lower wall positioned above the bed of the conveyor, means for supplying heated gas to the second plenum chamber, and means for injecting gas from the second plenum chamber to the space below said lower wall.

7. An oven as claimed in claim 6, in which the injecting means comprises a set of slots formed in said lower wall, each slot being oriented so that its projection onto the bed of the conveyor is inclined to the direction of travel of the metal sheets along the conveyor by an angle less than 90° .

8. An oven as claimed in claim 7, in which the slots are arranged in pairs, the pair of slots being arranged so as to present a V-shaped profile.

9. An oven as claimed in claim 2, including means for supplying heated gas to the plenum chamber located beneath the bed within the heating section.

10. An oven as claimed in claim 2, including a cooling section which is located downstream in the direction of travel of the workpieces from the heating section.

11. An oven as claimed in claim 2, in which the heating section includes at least one induction coil and means for supplying alternating current to the or each induction coil.

12. An oven as claimed in claim 2 or claim 10, combined with an apparatus for applying coating material to the metal sheets.

* * * * *

UNITED STATES PATENT AND TRADEMARK OFFICE

CERTIFICATE OF CORRECTION

PATENT NO. : 5,504,271

DATED : April 2, 1996

INVENTOR(S) : Michael Curtis; John Clarke; David J. Lusty; David L. Allinson; Geoffrey H. Rumble It is certified that error appears in the above-indentified patent and that said Letters Patent is hereby corrected as shown below:

Abstract, line 4, after "also" change "as" to -- has --.

Column 8, line 32, after "through" insert -- the --.

Column 11, line 19, delete "sheets" (second occurrence).

Column 11, line 27, delete "or" (second occurrence).

Signed and Sealed this

Twenty-second Day of October, 1996

*Attest:*

Bruce Lehman

BRUCE LEHMAN

*Attesting Officer*

*Commissioner of Patents and Trademarks*